United States Patent [19]

Planakis

[11] 4,293,129

[45] Oct. 6, 1981

[54] GAME RACKETS AND PADDLES WITH NONPARALLEL PLAYING SURFACES

[76] Inventor: Leo N. Planakis, 1701 Pebble Beach Dr., Vienna, Va. 22180

[21] Appl. No.: 40,924

[22] Filed: May 21, 1979

[51] Int. Cl.[3] ..... A63B 49/02; A63B 59/04

[52] U.S. Cl. ..... 273/67 R; 273/73 C; 273/76

[58] Field of Search ..... 273/67 R, 67 B, 73 R, 273/73 C, 73 D, 76, 26 B, 29 A; D21/211–213

[56] References Cited

U.S. PATENT DOCUMENTS

| | | | |
|---|---|---|---|
| D. 257,545 | 11/1980 | Castelli | D21/213 |
| 1,930,281 | 10/1933 | Ogden | 273/67 R |
| 3,239,224 | 3/1966 | Finn et al. | 273/73 R |
| 3,674,268 | 7/1972 | Shellman | 273/76 |
| 3,968,966 | 7/1976 | D'Aquanni | 273/73 D |

FOREIGN PATENT DOCUMENTS

| | | | |
|---|---|---|---|
| 1173824 | 7/1964 | Fed. Rep. of Germany | 273/76 |
| 2447415 | 4/1976 | Fed. Rep. of Germany | 273/73 R |
| 7607209 | 1/1978 | Netherlands | 273/73 C |

*Primary Examiner*—Richard J. Apley
*Attorney, Agent, or Firm*—Charles E. Brown

[57] ABSTRACT

This relates to game rackets, such as tennis rackets, and to paddles, such as table tennis paddles, with two discrete playing surfaces wherein the planes of the playing surfaces intersect each other generally at the crown portion of the racket head or paddle blade. This relationship of the playing surfaces permits a greater arc of stroke by a player thereby permitting a struck ball to be propelled with a greater velocity. It also permits a player to strike a ball in a more forward position thereby making it easier for the player to "keep his eye on the ball," with a resulting better ball control.

10 Claims, 6 Drawing Figures

GAME RACKETS AND PADDLES WITH NONPARALLEL PLAYING SURFACES

This invention relates in general to new and useful improvements in sports equipment, and more particularly to novel game rackets and paddles with particular reference being made to tennis rackets and table tennis paddles.

In substantially all tennis rackets in use today, a single mesh of tensioned stringing lying in the median plane of the racket head frame constitutes the two playing surfaces of the racket. Also, substantially all table tennis paddles in use today are provided with a blade having two plane parallel faces which constitute the two playing surfaces of the paddle.

In the patents to Blache, U.S. Pat. No. 1,502,845, D'Aquanni, U.S. Pat. No. 3,968,966, and Blackburn, U.S. Pat. No. 4,049,269, it is proposed to provide a racket with two discrete playing surfaces, each consisting of a mesh of tensioned stringing disposed in a plane generally parallel to the plane of the other, and separated from the other by the thickness of the racket head frame. It is an object of the present invention to provide an improved racket of this "double-strung" type but differing from that proposed by Blache, D'Aquanni, and Blackburn in that the planes of the two discrete playing surfaces are not parallel but instead, intersect each other and the longitudinal axis of the racket in the vicinity of the crown of the racket head. It is a further object of this invention to provide an improved paddle which differs from the conventional parallel-faced paddle in that the planes of the two playing surfaces (i.e., the paddle blade faces) are not parallel but instead, intersect each other and the longitudinal axis of the paddle in the vicinity of either the crown or the shoulder of the paddle blade. This nonparallel relationship of the playing surfaces permits a greater arc of stroke by a player thereby enabling a player to propel a struck ball with a greater velocity, or alternately, enabling a player to propel a struck ball satisfactorily with less physical effort. It also permits a player to strike a ball in a more forward position thereby making it easier for the player to "keep his eye on the ball" with a resulting better ball control. Furthermore, the angular relationship between the playing surfaces and the longitudinal axis of the racket or paddle will induce spin to a struck ball, the spin axis being generally normal to the plane of the stroke, and thereby causing the ball to "hook" or "slice".

The present invention may be more readily understood by considering the following specification and claims in conjunction with the accompanying drawings.

IN THE DRAWINGS

Figures 1, 2, 3, 4, 5, 6:
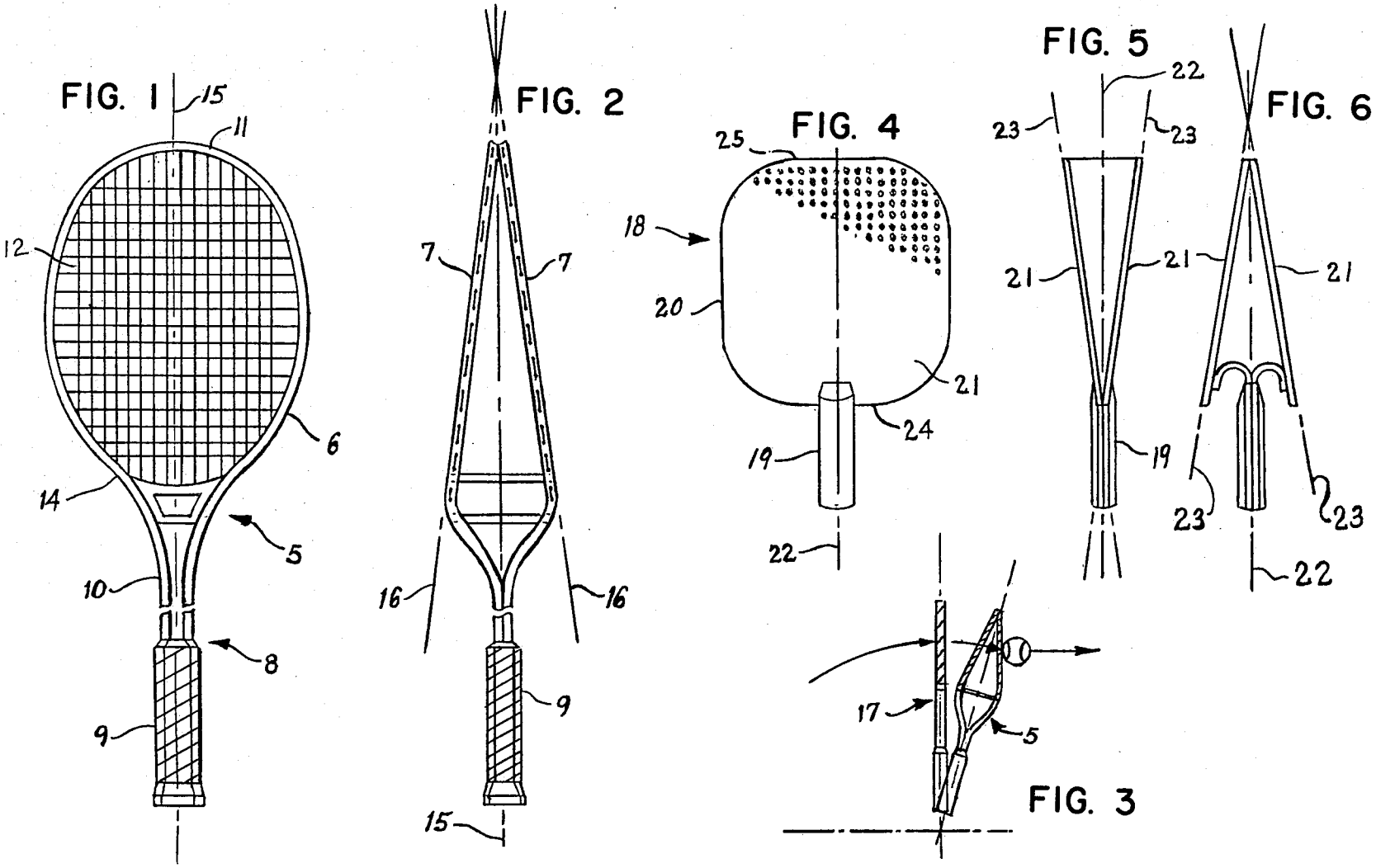
FIG. 1 is a plan view of a tennis racket formed in accordance with the present invention.
FIG. 2 is a side elevational view of the tennis racket in FIG. 1.
FIG. 3 is a schematic view on a reduced scale showing the difference in position between a conventional racket and a racket of the present invention when striking a ball.
FIG. 4 is a plan view of a table tennis paddle formed in accordance with the present invention.
FIG. 5 is a side elevational view of the table tennis paddle in FIG. 4 wherein the planes of the playing surfaces intersect generally at the shoulder of the paddle blade.
FIG. 6 is a side elevational view of the table tennis paddle in FIG. 4 wherein the planes of the playing surfaces intersect generally at the crown of the paddle blade.

Referring now to the drawings in detail, it will be seen that there is illustrated a tennis racket generally identified by the numeral 5. The racket 5 includes a head 6 consisting of two oval frames 7 joined at the crown portion 11 of the head 6 and each supporting a conventional mesh of tensioned stringing 12. The racket 5 also includes a handle 8 which consists of a conventional handgrip portion 9 and a double bifurcated shank portion 10 which connects the handgrip portion 9 to the shoulder portion 14 of the head 6.

In plan, the racket 5 has the appearance of a conventional racket which lies generally in a single plane. However, as shown in FIG. 2, the racket head 6 consists of two oval frames 7 disposed in angular relation to the longitudinal axis 15 of the racket 5. In the illustrated form of the racket 5, the angle included between the axis 15 and the plane 16 of each racket head frame 7 is eight degrees. This angle may vary, with the preferred range being on the order of two to sixteen degrees.

It will be seen also that there is illustrated a table tennis paddle generally identified by the numeral 18. The paddle 18 includes a handle 19 and a blade 20. The blade 20 includes two playing surfaces 21 disposed in angular relation to the longitudinal axis 22 of the paddle 18. In the form of the paddle 18 illustrated in FIG. 5, the planes 23 of the playing surfaces 21 intersect at the shoulder portion 24 of the blade 20. In the form of the paddle 18 illustrated in FIG. 6, the planes 23 of the playing surfaces 21 intersect at the crown portion of the blade 20.

The angular relation between the longitudinal axis of a racket of the present invention and the planes of the racket head frames enables a player to strike the ball in a more forward position thereby making it easier to "keep his eye on the ball," with a resulting better ball control. In order to more readily understand this, reference is made to FIG. 3 wherein the racket 17 represents a conventional planar racket. Table tennis paddles of the form illustrated in FIG. 6 also exhibit this improvement.

The angular relation between the longitudinal axis of the racket and the planes of the racket head frames also enables a player to propel a ball with greater velocity (as compared to a conventional planar racket). The increase in velocity has been analytically determined to be approximately five percent.

Rackets and paddles of the present invention will induce spin to a struck ball because of the angular relation between the playing surfaces and the longitudinal axis of the racket or paddle. The spin axis will be generally normal to the plane of the stroke. Rackets of the present invention and paddles of the form illustrated in FIG. 6 will cause a ball to "slice" when the stroke is generally horizontal. Paddles of the form illustrated in FIG. 5 will cause a ball to "hook".

It is believed that use of the racket of the present invention will reduce the incidence of the ailment known as "tennis elbow". With the understanding that a tennis ball is propelled by the transfer of momentum from the racket to the ball, and that momentum is a vector quantity which is conserved, it has been determined by vector analysis that the action of striking a ball with a racket of the present invention produces a component of momentum along the longitudinal axis of the racket toward the butt end of the racket handle. This decreases the stress on the player's contracted forearm extensor muscles from that which otherwise would result from using a conventional planar racket. This occurs because, when using a racket of the present invention, the ball is propelled normal to the plane of the racket head frame and not normal to the velocity vector of the center of mass of the racket, the latter being the case when using a conventional planar racket.

Although this invention has been specifically illustrated and described with respect to a tennis racket and a table tennis paddle, it is to be understood that the principles of this invention are applicable wholly or in part to many other types of rackets and paddles including, but not limited to those intented for use in the games of squash, badminton, racquetball, and platform tennis. Although only preferred embodiments of the racket and paddle have been specifically illustrated and described herein, it is to be understood that minor variations may be made in configuration and construction without departing from the spirit and scope of the invention as defined by the appended claims.

I claim:

1. A game racket comprising a head and a handle, said head having two discrete, nonparallel strung surfaces, each of said strung surfaces being a mesh of tensioned stringing, said handle comprising a hand grip portion and a shank portion, said shank portion joined to the shoulder portion of said head, and the line of intersection of the planes of said strung surfaces being generally normal to and intersecting the longitudinal axis of said racket generally at the crown portion of said head, said head being formed of two generally oval frames, and said frames being fixedly joined at said crown portion.

2. The racket of claim 1 wherein the angle of intersection of said planes is bisected by said longitudinal axis, and said angle is generally between two degrees and fifty degrees.

3. The racket of claim 1 wherein the angle of intersection of said planes is bisected by said longitudinal axis, and said angle is generally between four degrees and thirty-two degrees.

4. The racket of claim 1 wherein said shank portion is bifurcated and joined to said frames at said shoulder portion of said head.

5. A game racket according to claim 1 wherein each of said oval frames has spaced portions extending through said shoulder portion and said shank portion into said hand grip portion, and said hand grip portion includes four parallel frame components.

6. A paddle comprising a longitudinally extending handle and a blade unit, said blade unit having two plane, nonparallel playing surfaces defined by two blade members, said handle beng joined to a shoulder portion of said blade unit, and the line of intersection of the planes of said surfaces being generally normal to and intersecting a longitudinal axis of said paddle extending through said handle, and said blade members having like end portions joined together.

7. The paddle of claim 6 wherein the angle of intersection of said planes is bisected by said longitudinal axis, and said angle is generally between two degrees and fifty degrees.

8. The paddle of claim 6 wherein the angle of intersection of said planes is bisected by said longitudinal axis, and said angle is generally between four degrees and thirty-two degrees.

9. The paddle of claim 6 wherein said blade members are joined together at the crown portion of said blade unit.

10. The paddle of claim 6 wherein said blade members are joined together at said shoulder portion of said blade unit with portions of said blade members extending into and forming part of said handle.

* * * * *